US008007294B2

(12) United States Patent
Tanaka

(10) Patent No.: US 8,007,294 B2
(45) **Date of Patent: *Aug. 30, 2011**

(54) CONNECTOR

(75) Inventor: Yukitaka Tanaka, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 21 days.

This patent is subject to a terminal disclaimer.

(21) Appl. No.: 12/388,815

(22) Filed: Feb. 19, 2009

(65) Prior Publication Data

US 2009/0209120 A1 Aug. 20, 2009

(30) Foreign Application Priority Data

Feb. 20, 2008 (JP) ..... 2008-039099

(51) Int. Cl.
*H01R 13/40* (2006.01)

(52) U.S. Cl. ..... 439/108

(58) Field of Classification Search ..... 439/108, 439/607.5, 607.01, 751, 941, 107
See application file for complete search history.

(56) References Cited

U.S. PATENT DOCUMENTS

| | | | | |
|---|---|---|---|---|
| 6,935,870 | B2 | 8/2005 | Kato et al. | |
| 2008/0014803 | A1 * | 1/2008 | Kato et al. | 439/733.1 |
| 2009/0197441 | A1 | 8/2009 | Tanaka | |

FOREIGN PATENT DOCUMENTS

JP 2002-334748 A 11/2002

OTHER PUBLICATIONS

U.S. Office Action dated Nov. 24, 2009, issued in related U.S. Appl. No. 12/363,864.

U.S. Appl. No. 12/363,864, filed Feb. 2, 2009. First-named inventor Yukitaka Tanaka.

* cited by examiner

*Primary Examiner* — Alexander Gilman
(74) *Attorney, Agent, or Firm* — Holtz, Holtz, Goodman & Chick, PC

(57) ABSTRACT

A connector is provided which makes it possible to have the soldered states of contacts thereof checked or have itself removed with ease. A row formed by terminal portions of first and second signal contacts and terminal portions of ground contacts is disposed rearward in the fitting/removing direction with respect to rows formed by terminal portions of contacts for non-high-speed transmission. The terminal portions of contacts for non-high-speed transmission are disposed between the contact portions and terminal portions of the first and second signal contacts and the ground contacts. The terminal portions of the first and second signal contacts and the terminal portions of the ground contacts are formed to have a surface-mount type planar shape. The terminal portions of the contacts for non-high-speed transmission are each formed to have a through hole insertion-type pin shape.

4 Claims, 13 Drawing Sheets

CONNECTOR

BACKGROUND OF THE INVENTION

1. Field of the Invention

This invention relates to a connector, more particularly to a connector which is suitable for high-speed transmission of electric signals.

2. Description of the Related Art

Conventionally, there has been proposed a receptacle connector comprised of three types of contacts, an insulator for holding the contacts, and a receptacle shell for covering the insulator (see Japanese Laid-Open Patent Publication (Kokai) No. 2002-334748).

The three types of contacts include a signal contact S and a ground contact G for high-speed transmission, and a contact D for non-high-speed transmission. Each of the three types of contacts has contact portions which are capable of being brought into contact with contact portions of mating contacts of a mating connector, and terminal portions which are capable of being soldered to pads on a printed board.

The contact portions are arranged in two rows, one above the other (see FIG. 7(b) in the above-mentioned Patent Publication) One ground contact G in the upper row and a pair of signal contacts S and S in the lower row which are located below the ground contact G form one contact group for high-speed transmission, while one ground contact G in the lower row and a pair of signal contacts S and S in the upper row which are located above the ground contact G form one contact group for high-speed transmission.

The terminal portions are arranged in a row along the direction of the width of the insulator (the contact arranging direction). One ground contact G and a pair of signal contacts S and S located on opposite sides of the ground contact G form one contact group for high-speed transmission.

In the above-described arrangement of the contact portions, only the pair of signal contacts S located at a right end in the upper row are not in a state sandwiched by ground contacts G. As a result, variation in transmission characteristics is caused between the pair of signal contacts S and the other pairs of signal contacts, and there is a fear that crosstalk may occur between the pair of signal contacts S and other pairs of signal contacts located obliquely below.

Further, in the arrangement of the terminal portions, the signal contacts of adjacent contact groups in the direction of the width of the insulator are adjacent to each other, and hence there is a fear that crosstalk occurs between these signal contacts.

Furthermore, since the terminal portions are arranged in a row along the direction of the width of the insulator, the connector suffers from the problem of an increase in size.

The present inventors invented a connector for solving the problems, and the present assignee filed a patent application for the invention (Japanese Patent Application No. 2008-39099).

In this connector, the contact portions of the signal contacts for high-speed transmission and the contact portions of the ground contacts for high-speed transmission are arranged in a row in a contact arranging direction which is orthogonal to a connector fitting direction. Each pair of the contact portions of the signal contacts for high-speed transmission are disposed between the contact portions of ones of the ground contacts for high-speed transmission which are adjacent in the contact arranging direction.

Further, the contact portions of the contacts for non-high-speed transmission are arranged in a row in the contact arranging direction. The row formed by the contact portions of the signal contacts for high-speed transmission and the contact portions of the ground contacts for high-speed transmission, and the row formed by the contact portions of the contacts for non-high-speed transmission are parallel to each other.

Therefore, variation in transmission characteristics and crosstalk are suppressed.

Further, the connection portions of the signal contacts for high-speed transmission and the connection portions of the ground contacts for high-speed transmission are arranged in a row in the contact arranging direction. The connection portions of each pair of the signal contacts for high-speed transmission are disposed between the connection portions of ones of the ground contacts for high-speed transmission which are adjacent in the contact arranging direction.

The connection portions of the contacts for non-high-speed transmission are arranged in the contact arranging direction. The row formed by the connection portions of the signal contacts for high-speed transmission and the connection portions of the ground contacts for high-speed transmission, and the row formed by the connection portions of the contacts for non-high-speed transmission are parallel to each other.

Therefore, variation in transmission characteristics is suppressed, and it is possible to reduce the size of the connector.

However, although the connection portions of the contacts for non-high-speed transmission each have a surface-mount type planar shape and are reflow-soldered to pads of a printed board, these connection portions are between the contact portions and connection portions of the signal contacts for high-speed transmission and the ground contacts for high-speed transmission in the fitting direction and below the housing. This prevents the soldered state of the connection portions from being checked (viewed).

Further, when the connector is removed from the circuit board so as to repair the same, although the connection portions of the signal contacts for high-speed transmission and the ground contacts for high-speed transmission protrude out of the housing, and hence it is possible to directly apply a soldering iron to the connection portions, but the connection portions of the contacts for non-high speed transmission are positioned below the housing, and hence it is difficult to directly apply the soldering iron to the connection portions. Therefore, it is difficult to remove the connection portions for non-high-speed transmission from pads of the printed board.

Although a method can be envisaged in which the printed board having the connector mounted thereon is placed in a reflow oven to thereby melt the solder instead of directly applying the soldering iron to the connection portions, the method is not appropriate for melting the solder since soldered portions of electronic parts mounted on the printed board other than the connector are also melted, which can cause undesired effects, such as making the electronic parts movable.

Therefore, it is practically impossible to remove the connector from the printed board after all, and hence there is no other way than to repair the connector in a state mounted on the printed board.

Thus, the present inventor became aware that the connector filed as the invention with the Japanese Patent Office for a patent application by the present assignee suffers from a problem that it is impossible to check the soldered states of the connection portions of the contacts for non-high-speed transmission or it is difficult to remove the connector from the printed board.

SUMMARY OF THE INVENTION

The present invention has been made in view of these circumstances, and an object thereof is to provide a connector which makes it possible to have the soldered states of contacts thereof checked or have itself removed with ease.

To attain the above object, the present invention provides a connector comprising a housing that is capable of being fitted to a mating housing of a mating connector, and a plurality of contacts that are held by the housing, the plurality of contacts including pairs of signal contacts for high-speed transmission, ground contacts for high-speed transmission, and contacts for non-high-speed transmission, wherein each of the signal contacts for high-speed transmission, the ground contacts for high-speed transmission, and the contacts for non-high-speed transmission has a contact portion which is capable of being brought into contact with a contact portion of a mating contact of the mating connector, and a connection portion which is connected to an object to be connected, wherein the contact portions of the signal contacts for high-speed transmission and the contact portions of the ground contacts for high-speed transmission are arranged in a row in a contact arranging direction which is orthogonal to a connector fitting direction, wherein the contact portions of each pair of the signal contacts for high-speed transmission are disposed between the contact portions of ones of the ground contacts for high-speed transmission adjacent in the contact arranging direction, wherein the contact portions of the contacts for non-high-speed transmission are arranged in a row in the contact arranging direction, wherein the row formed by the contact portions of the signal contacts for high-speed transmission and the contact portions of the ground contacts for high-speed transmission, and the row formed by the contact portions of the contacts for non-high-speed transmission are parallel to each other, wherein the connection portions of the signal contacts for high-speed transmission and the connection portions of the ground contacts for high-speed transmission are arranged in a row in the contact arranging direction, wherein the connection portions of each pair of the signal contacts for high-speed transmission are disposed between ones of the connection portions of the ground contacts for high-speed transmission adjacent in the contact arranging direction, wherein the connection portions of the contacts for non-high-speed transmission are arranged in two rows in the contact arranging direction, wherein the row formed by the connection portions of the signal contacts for high-speed transmission and the connection portions of the ground contacts for high-speed transmission, and the rows formed by the connection portions of the contacts for non-high-speed transmission are parallel to each other, wherein the row formed by the connection portions of the signal contacts for high-speed transmission and the connection portions of the ground contacts for high-speed transmission is disposed rearward in the connector fitting direction with respect to the rows formed by the connection portions of the contacts for non-high-speed transmission, wherein the connection portions of the contacts for non-high-speed transmission are between the contact portions and the connection portions of the signal contracts for high-speed transmission and the ground contacts for high-speed transmission in the connector fitting direction, wherein the connection portions of the contacts for non-high-speed transmission are in a staggered arrangement, wherein the connection portions of the contacts for high-speed transmission and the connection portions of the ground contacts for high-speed transmission each have a surface-mount type planar shape, wherein the connection portions of the contacts for non-high-speed transmission each have a through hole insertion-type pin shape, and wherein the connection portions of the signal contracts for high-speed transmission and the connection portions of the ground contacts for high-speed transmission protrude out of the housing.

In the connector according to the present invention, the connection portions of the contacts for non-high-speed transmission each have a through hole insertion-type pin shape. Therefore, after the connection portions are soldered, it is possible to check soldered states of the connection portions. Further, protruding portions of the connection portions which protrude out of the through holes can be directly heated using a soldering iron or the like, which makes it possible to easily remove the connector.

Preferably, the plurality of contacts each have a substantially L-shape.

Preferably, each of the plurality of contacts is formed by blanking and bending a metal plate having elasticity.

According to this invention, it is possible to check the soldered states of the contacts or remove the connector with ease.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1A:
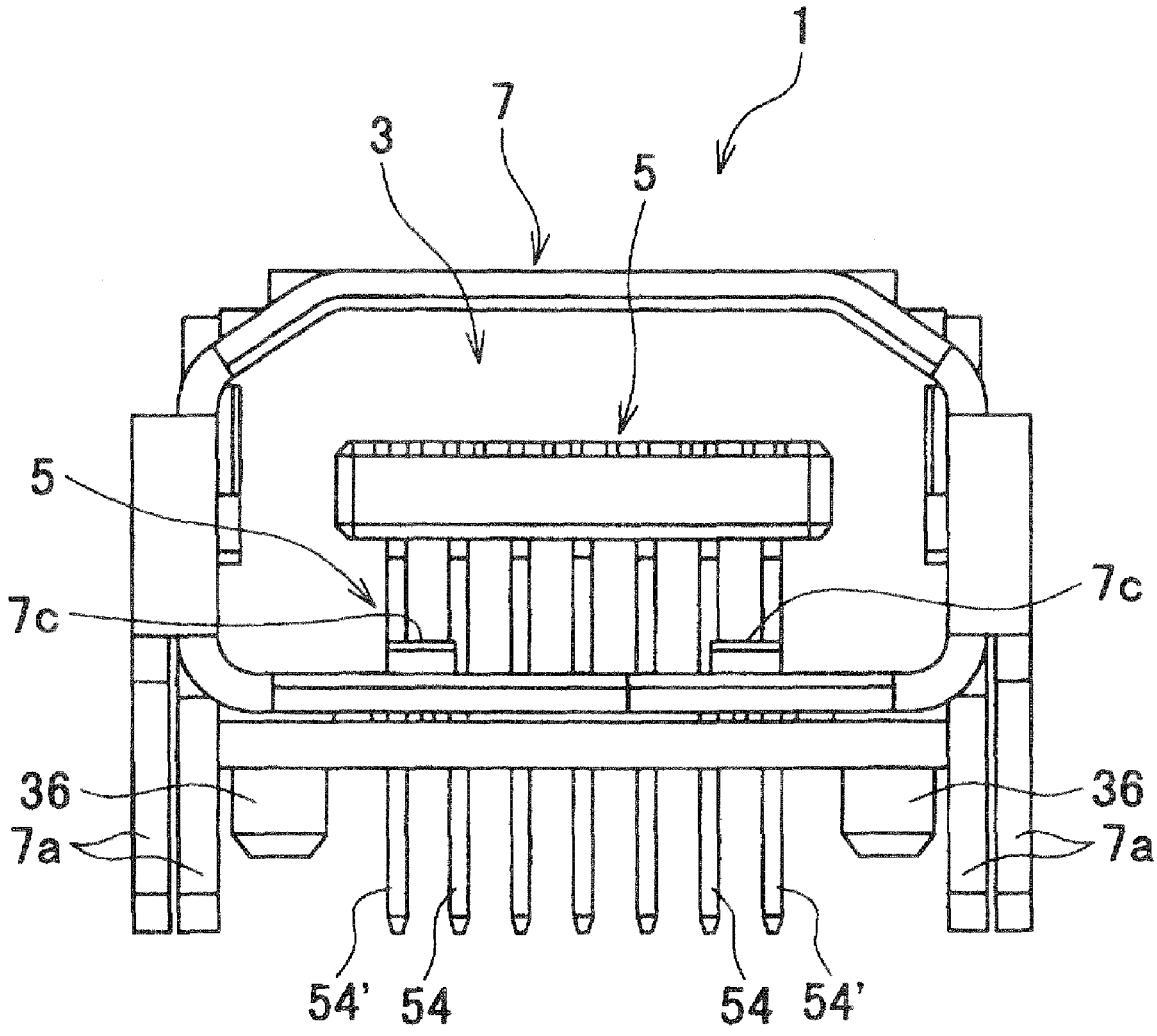
FIG. 1A is a front view of a connector according to a first embodiment of the present invention.
Figure 1B:
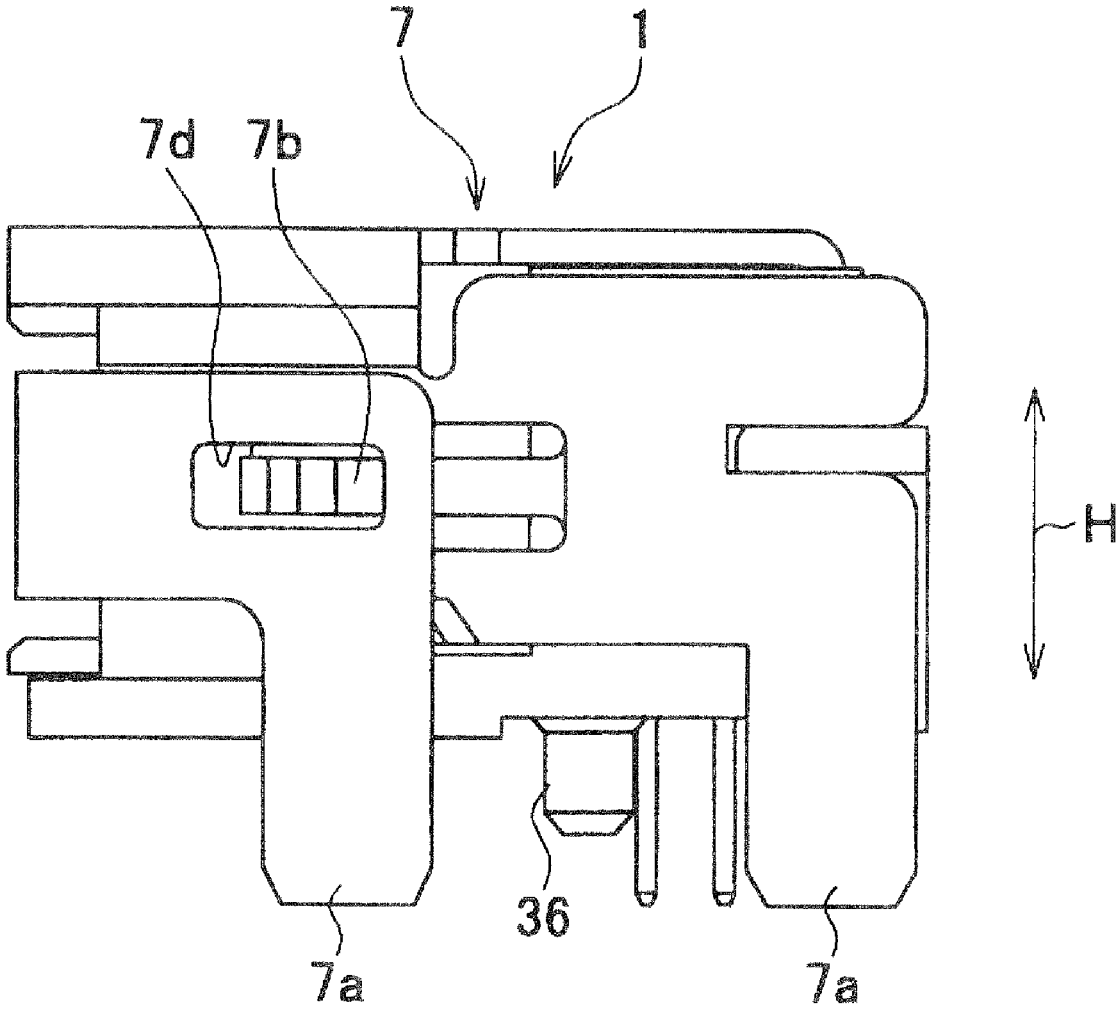
FIG. 1B is a side view of the connector.
Figure 1C:
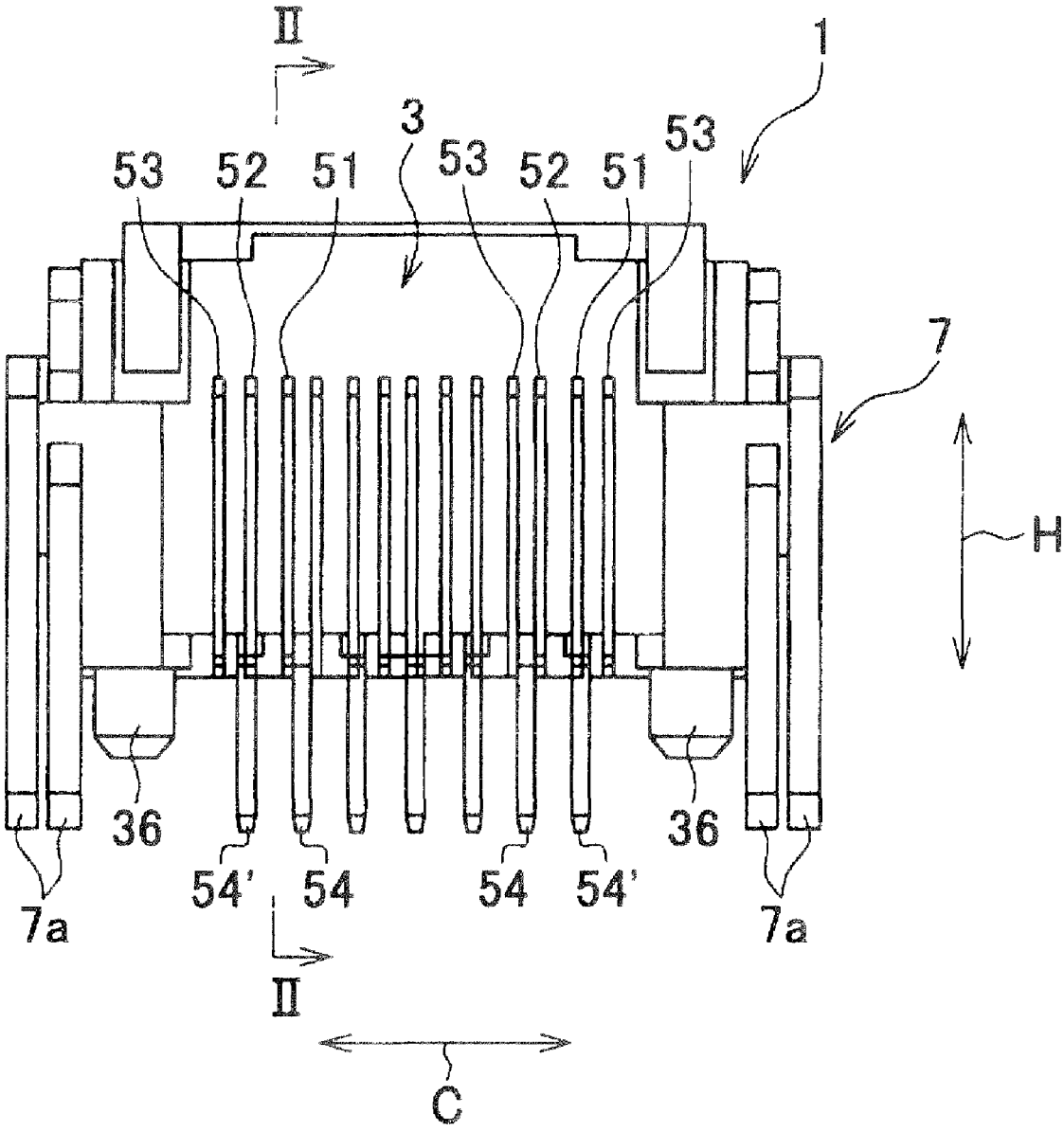
FIG. 1C is a rear view of the connector.
Figure 2:
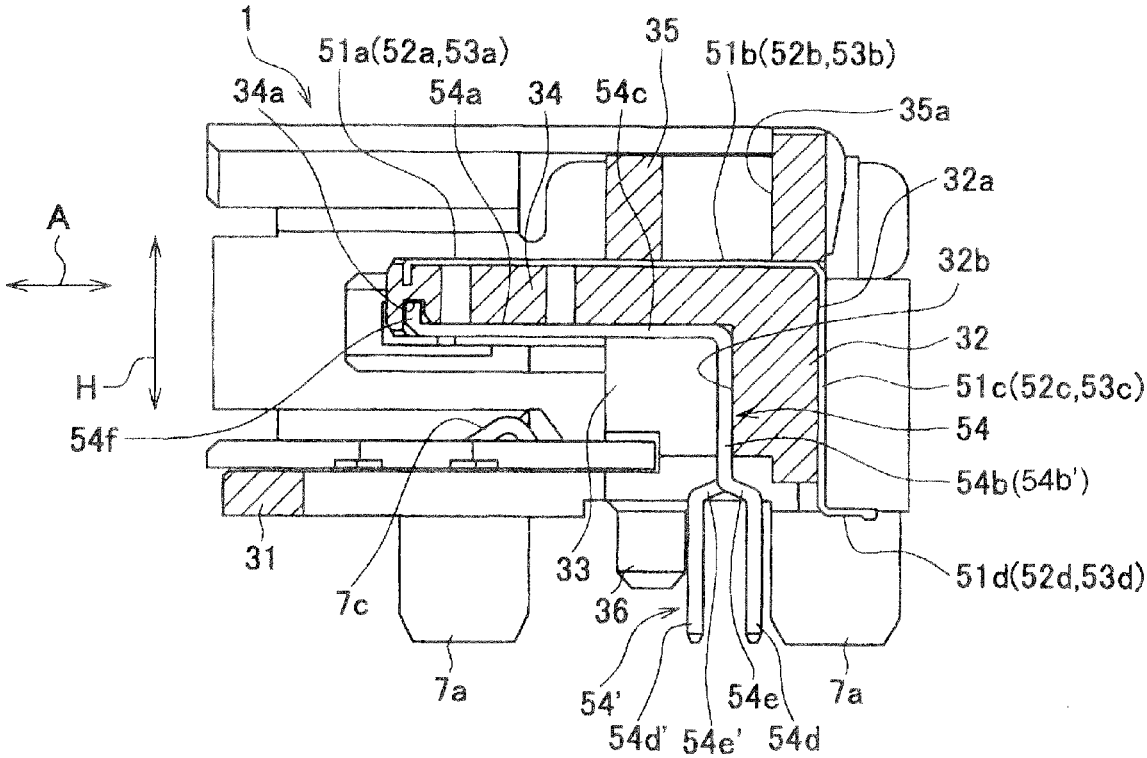
FIG. 2 is a cross-sectional view taken on line II-II of FIG. 1C.

Referring to FIGS. 1A to 2, a connector 1 is comprised of a housing 3, a plurality of contacts 5, and a shell 7.

Figure 6:
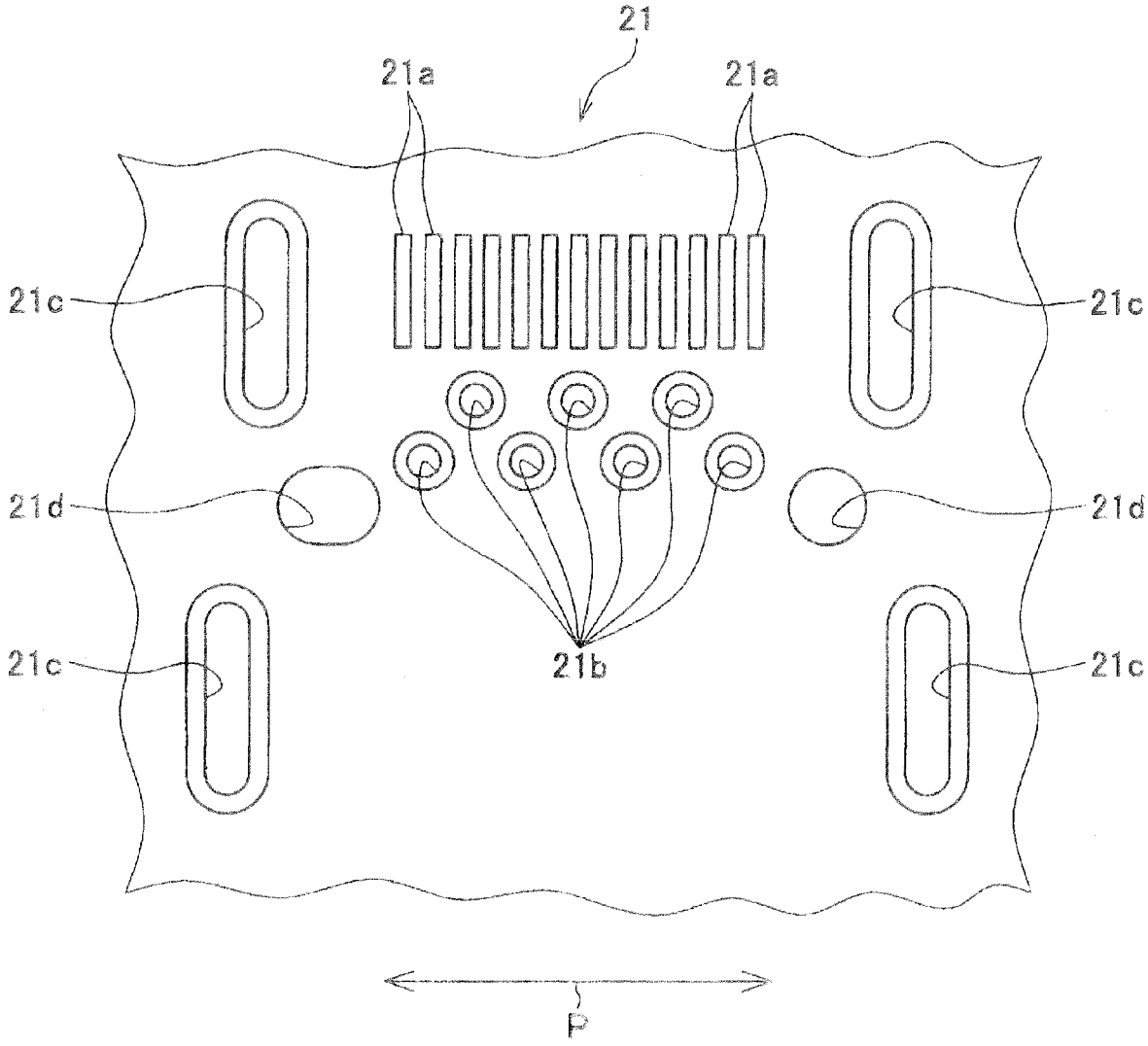
FIG. 6 is a plan view of part of a printed board on which the connector shown in FIGS. 1A to 1C is mounted.

The housing 3 is made of a resin having insulation properties. The housing 3 includes a bottom board 31, a rear wall portion 32, side wall portions 33, a holding portion 34, and a projecting portion 35 (see FIG. 2). The bottom board 31 has a plate-like shape, and has a bottom surface having a pair of positioning bosses 36 formed thereon. The positioning bosses 36 are inserted in positioning holes 21*d* of a printed board 21 (object to be connected), shown in FIG. 6. The rear wall portion 32 is continuous with the rear of the bottom board 31. The rear wall portion 32 has a front-side surface (inner surface) thereof formed with a plurality of press-fitting grooves 32*b*, and a rear-side surface (outer surface) thereof formed with a plurality of press-fitting grooves 32*a*, at equally-spaced intervals, respectively. The press-fitting grooves 32*a* and 32*b* extend in a direction H of the height of the housing 3 (direction orthogonal to a contact arranging direction C and a fitting/removing direction A). Two side wall portions 33 are continuous with the opposite sides of the rear wall portion 32. The holding portion 34 has a plate-like shape, and is continuous with the rear wall portion 32. The holding portion 34 extends along a fitting/removing direction A (connector fitting direction) in which the housing 3 is fitted in and removed from a mating housing 203 of a mating connector 201, referred to hereinafter (see FIGS. 7A, 7B and 8), and is parallel to the bottom board 31. The projecting portion 35 is continuous with the rear wall portion 32, both of the side wall portions 33, and the holding portion 34. An impedance value is adjusted by the projecting portion 35. The projecting portion 35 has a hole 35*a* formed therein for adjusting the impedance value.

Figure 3:
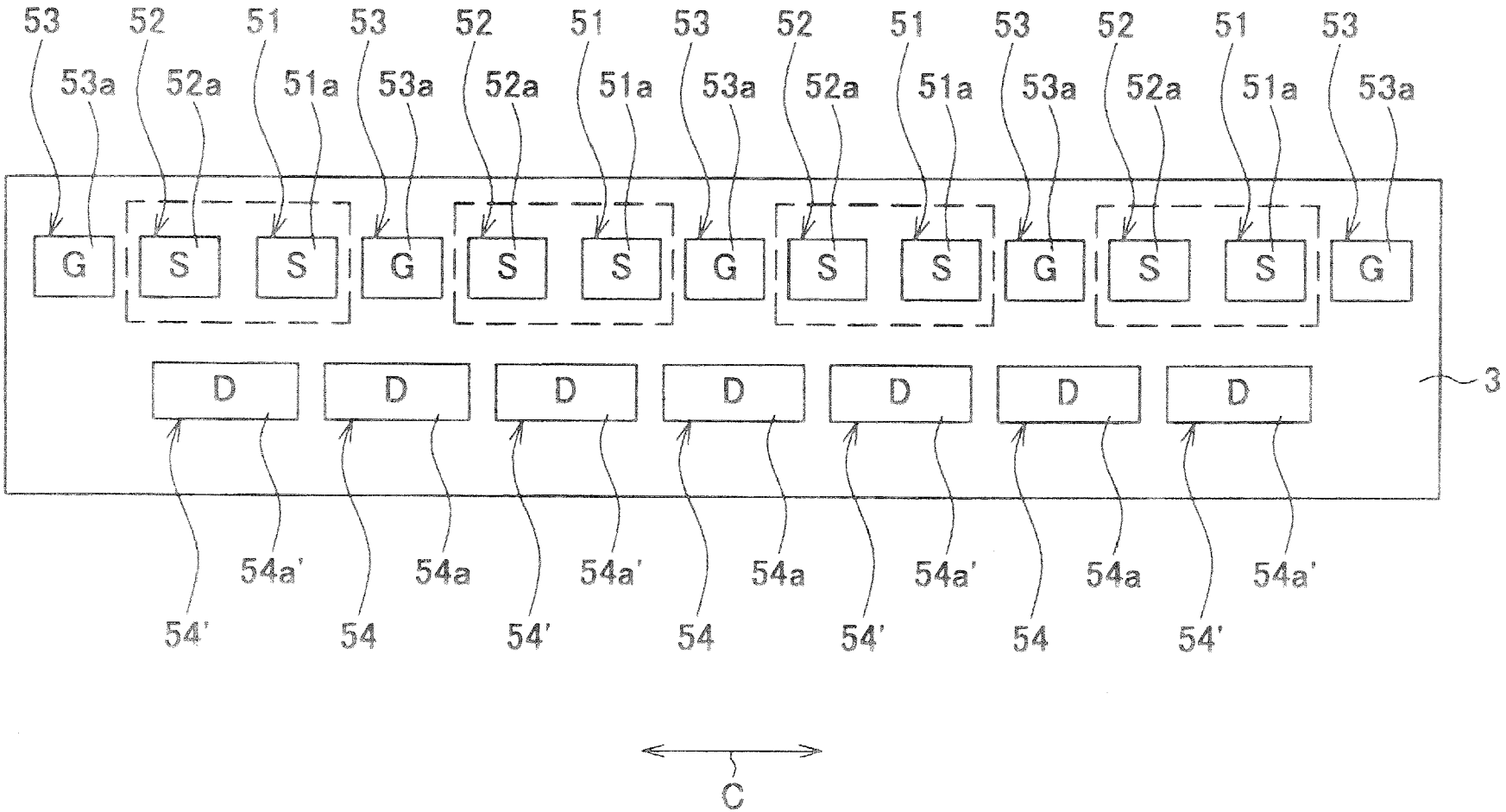
FIG. 3 is a conceptual view of an arrangement of contact portions of contacts of the connector shown in FIGS. 1A to 1C.
Figure 4:
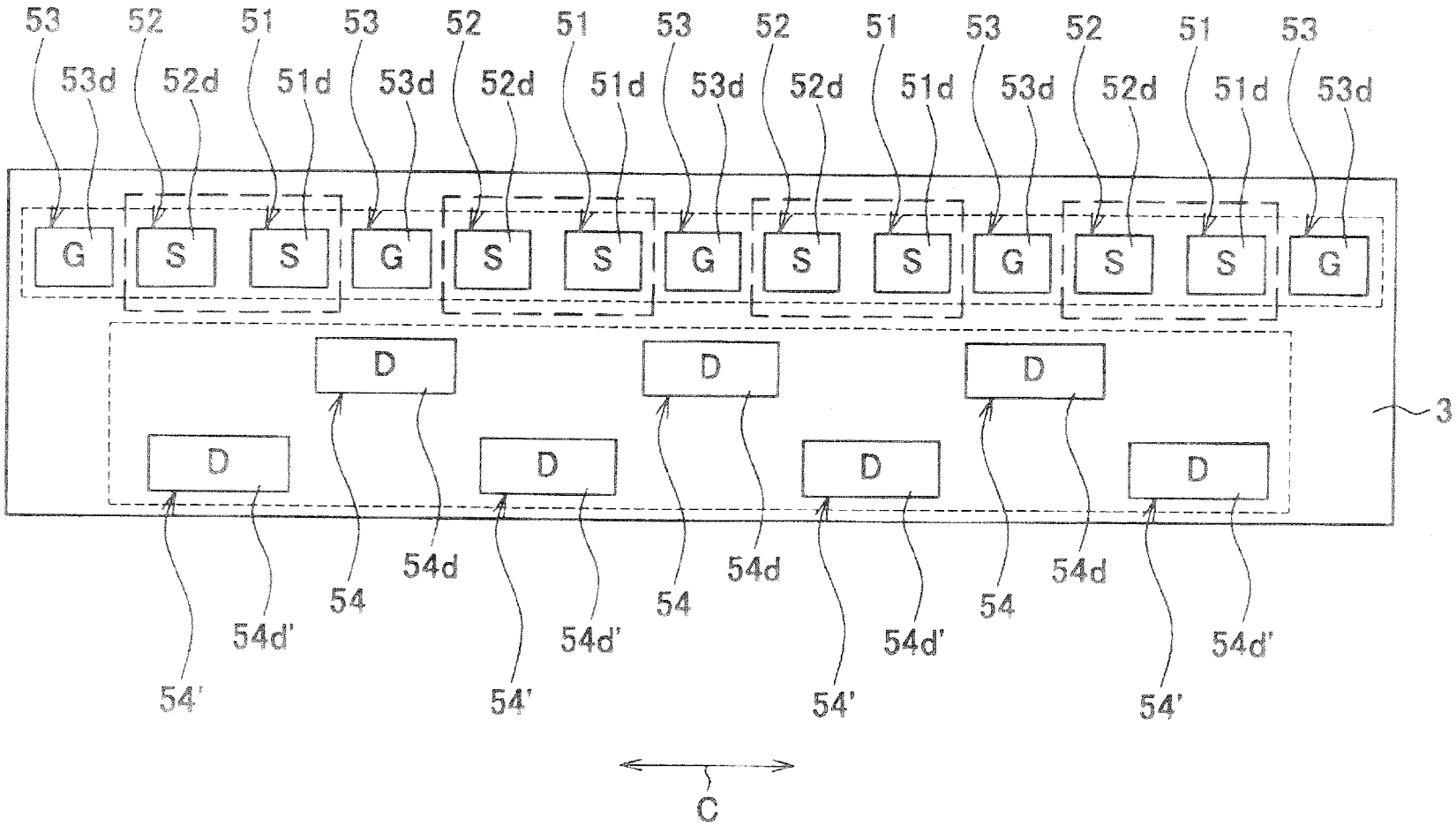
FIG. 4 is a conceptual view of an arrangement of terminal portions of the contacts of the connector shown in FIGS. 1A to 1C.

Referring to FIGS. 3 and 4, the contacts 5 include contacts for high-speed transmission, and contacts for non-high-speed transmission. The contacts for high-speed transmission include first signal contacts (signal contacts for high-speed transmission) 51, second signal contacts (signal contacts for high-speed transmission) 52, and ground contacts (ground contacts for high-speed transmission) 53. These contacts 51, 52, and 53 are disposed at predetermined space intervals in the housing 3. The distance between each first signal contact 51 and each second signal contact 52 adjacent to each other is larger than the distance between each second signal contact 52 and each ground contact 53 adjacent to each other. The contacts for non-high-speed transmission include contacts 54 and contacts 54'. The contacts 54 and the contacts 54' are alternately arranged in the housing 3 at equally-spaced intervals. One first signal contact 51 and one second signal contact 52 form a pair of signal contacts for high-speed transmission. A pair of signal contacts 51, 52 for high-speed transmission, and one ground contact 53 form one contact group for differential signal transmission.

As shown in FIG. 2, each first signal contact 51 has a contact portion 51*a*, a fixing portion 51*b*, a connecting portion 51*c*, and a terminal portion (connection portion) 51*d*, and is formed by blanking and bending a metal plate having elasticity. The contact portion 51*a* is brought into contact with an associated one of first signal contacts 251 (shown in FIG. 7A) of the mating connector 201. The contact portion 51*a* is disposed on the upper surface of the holding portion 34. The fixing portion 51*b* is embedded in the housing 3 by a so-called mold-in method. The fixing portion 51*b* extends in a fitting/removing direction A. The connecting portion 51*c* connects the fixing portion 51*b* and the terminal portion 51*d*. The terminal portion 51*d* is continuous with the connecting portion 51*c*. The terminal portion 51*d* has a surface-mount type planar shape, and is soldered to an associated one of pads 21*a* (see FIG. 6) on the printed board 21.

The second signal contact 52 has the same shape as the first signal contact 51, and hence reference numerals (52*a* to 52*d*) concerning the second signal contact 52 are shown in parentheses beside reference numerals (51*a* to 51*d*) concerning the first signal contact 51, and illustration of the second signal contacts 52 is omitted from FIG. 2. Each second signal contact 52 has a contact portion 52*a*, a fixing portion 52*b*, a connecting portion 52*c*, and a terminal portion (connection portion) 52*d*, and is formed by blanking and bending a metal plate having elasticity. The contact portion 52*a* is brought into contact with an associated one of second contacts 252 (shown in FIG. 7A) of the mating connector 201. The contact portion 52*a* is disposed on the upper surface of the holding portion 34. The fixing portion 52*b* is embedded in the housing 3 by the so-called mold-in method. The fixing portion 52*b* extends in a fitting/removing direction A. The connecting portion 52*c* connects the fixing portion 52*b* and the terminal portion 52*d*. The terminal portion 52*d* is continuous with the connecting portion 52*c*. The terminal portion 52*d* has a surface-mount type planar shape, and is soldered to an associated one of the pads 21*a* (see FIG. 6) on the printed board 21.

The ground contact 53 has the same shape as the first signal contact 51, and hence reference numerals (53*a* to 53*d*) concerning the ground contact 53 are shown in parentheses beside the reference numerals (51*a* to 51*d*) concerning the first signal contact 51, and illustration of the ground contacts 53 is omitted from FIG. 2. Each ground contact 53 has a contact portion 53*a*, a fixing portion 53*b*, a connecting portion 53*c*, and a terminal portion (connection portion) 53*d*, and is formed by blanking and bending a metal plate having elasticity. The contact portion 53*a* is brought into contact with an associated one of ground contacts 253 (shown in FIG. 7A) of the mating connector 201. The contact portion 53*a* is disposed on the upper surface of the holding portion 34. The fixing portion 53*b* is embedded in the housing 3 by the so-called mold-in method. The fixing portion 53*b* extends in a fitting/removing direction A. The connecting portion 53*c* connects the fixing portion 53*b* and the terminal portion 53*d*. The terminal portion 53*d* is continuous with the connecting portion 53*c*. The terminal portion 53*d* has a surface-mount type planar shape, and is soldered to the pad 21*a* (see FIG. 6) on the printed board 21.

As shown in FIG. 2, each contact 54 for non-high-speed transmission has a contact portion 54*a*, a press-fitting portion 54*b*, a connecting portion 54*c*, a terminal portion (connection portion) 54*d*, an position changing portion 54*e*, and a disconnection prevention portion 54*f*, and is formed by blanking and bending a metal plate having elasticity. The contact portion 54*a* is brought into contact with an associated one of contacts 254 for non-high-speed transmission (shown in FIG. 7A) of the mating connector 201. The contact portion 54*a* is disposed on the lower surface of the holding portion 34. The press-fitting portion 54*b* is press-fitted in a associated one of the press-fitting grooves 32*b* of the housing 3. The connecting portion 54*c* connects the contact portion 54*a* and the press-fitting portion 54*b*. The terminal portion 54*d* has a through hole insertion-type pin shape, and is inserted into an associated one of through holes 21*b* (see FIG. 6) of the printed board 21 so as to be soldered thereto. The position changing portion 54e connects the press-fitting portion 54*b* and the terminal portion 54*d*. The position changing portion 54*e* is bent rearward, and changes the position of the terminal portion 54*d* (position in the fitting/removing direction A thereof) with respect to the press-fitting portion 54*b*. The terminal portion 54*d* is located rearward of the press-fitting portion 54*b*. The disconnection prevention portion 54*f* is engaged with an recess 34*a* in the holding portion 34, and is fixed to the holding portion 34 e.g. by an adhesive.

The contact 54' for non-high-speed transmission has a similar configuration as the contact 54 except an position changing portion 54*e*'. The position changing portion 54*e*' is bent forward, and a terminal portion 54*d*' is disposed forward of the press-fitting portion 54*b*'. As a result, the terminal portion 54*d* and the terminal portion 54*d*' are displaced in the fitting/removing direction A, and hence when the connector 1 is viewed from below, the terminal portions 54*d* and 54*d*' are in a staggered arrangement (see FIG. 4). Therefore, if the terminal portions 54*d* and 54*d*' are connected by imaginary straight lines, one zigzag line is formed in which mountain-like shapes each in bilateral symmetry are connected in the contact arranging direction C. The terminal portions 54*d*, 54*d*' are inserted into the respective associated through holes 21*b* of the printed board 21, and are soldered thereto. The through holes 21*b* in the printed board 21 are in a staggered arrangement matching the staggered arrangement of the terminal portions 54*d*, 54*d*' (see FIG. 6)

In the contact 54 for non-high-speed transmission of the connector 1 according to the present embodiment, the terminal portion 54*d* is caused to be disposed at a location rearward of the press-fitting portion 54*b* (location in the fitting/removing direction A) by the position changing portion 54*e*. However, insofar as the terminal portions 54*d* of the contacts 54 for non-high-speed transmission and the terminal portions 54*d*' of the contacts 54' are in a staggered arrangement, the locations of the terminal portions 54*d* (locations thereof in the fitting/removing direction A) may be configured to be at the same locations (in the fitting/removing direction A) as the press-fitting portions 54*b*, or forward of the same (in the fitting/removing direction A).

Figure 5A:
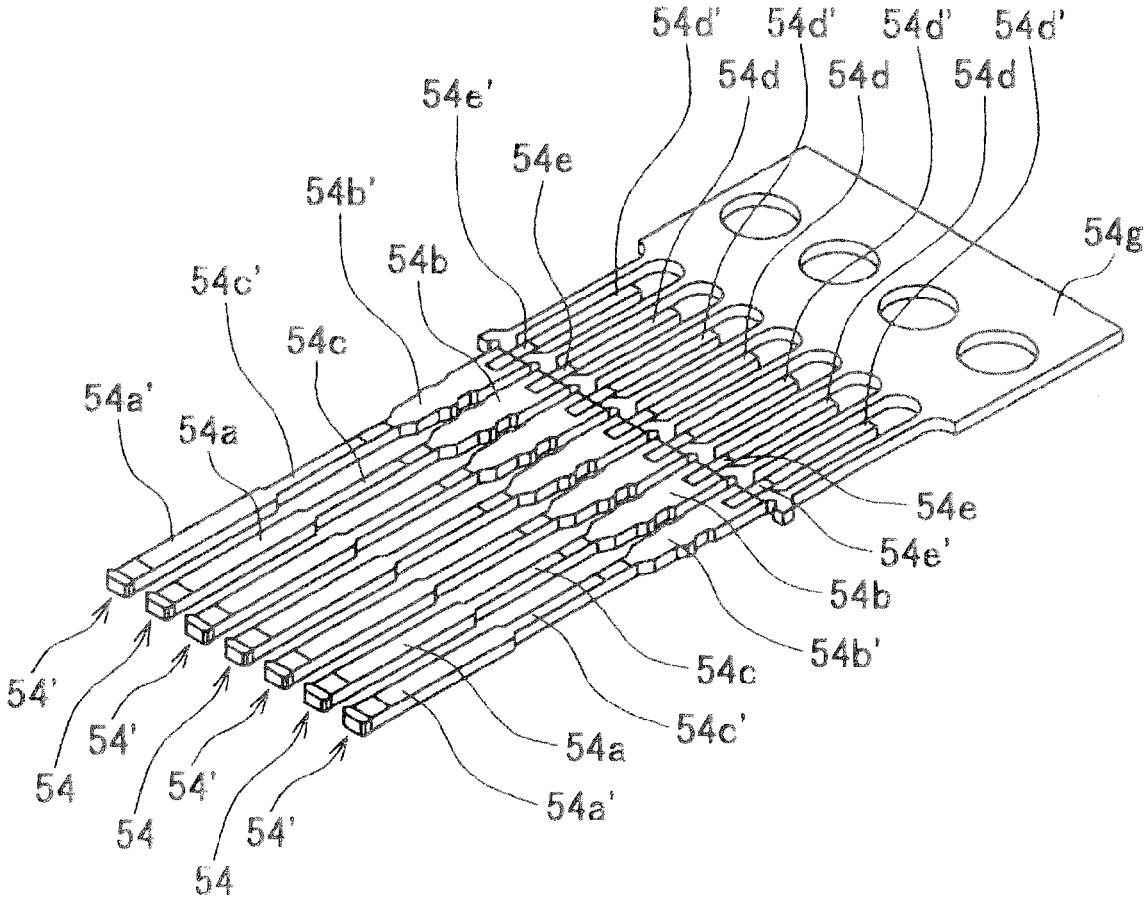
FIG. 5A is a perspective view of contacts for non-high-speed transmission appearing in FIGS. 1A to 1C in a straight state.
Figure 5B:
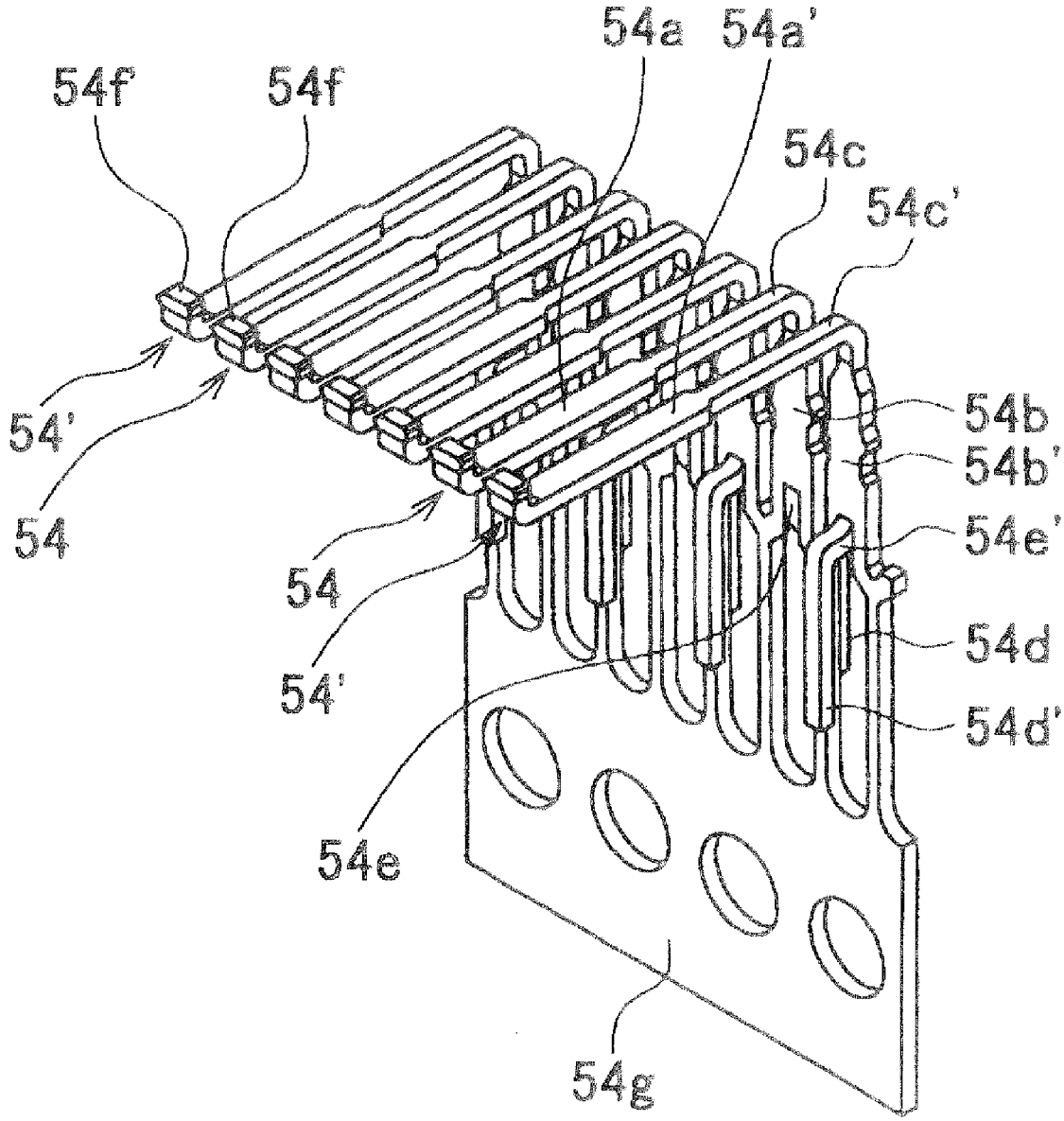
FIG. 5B is a perspective view of the contacts shown in FIG. 5A in a bent state.
Figure 5C:
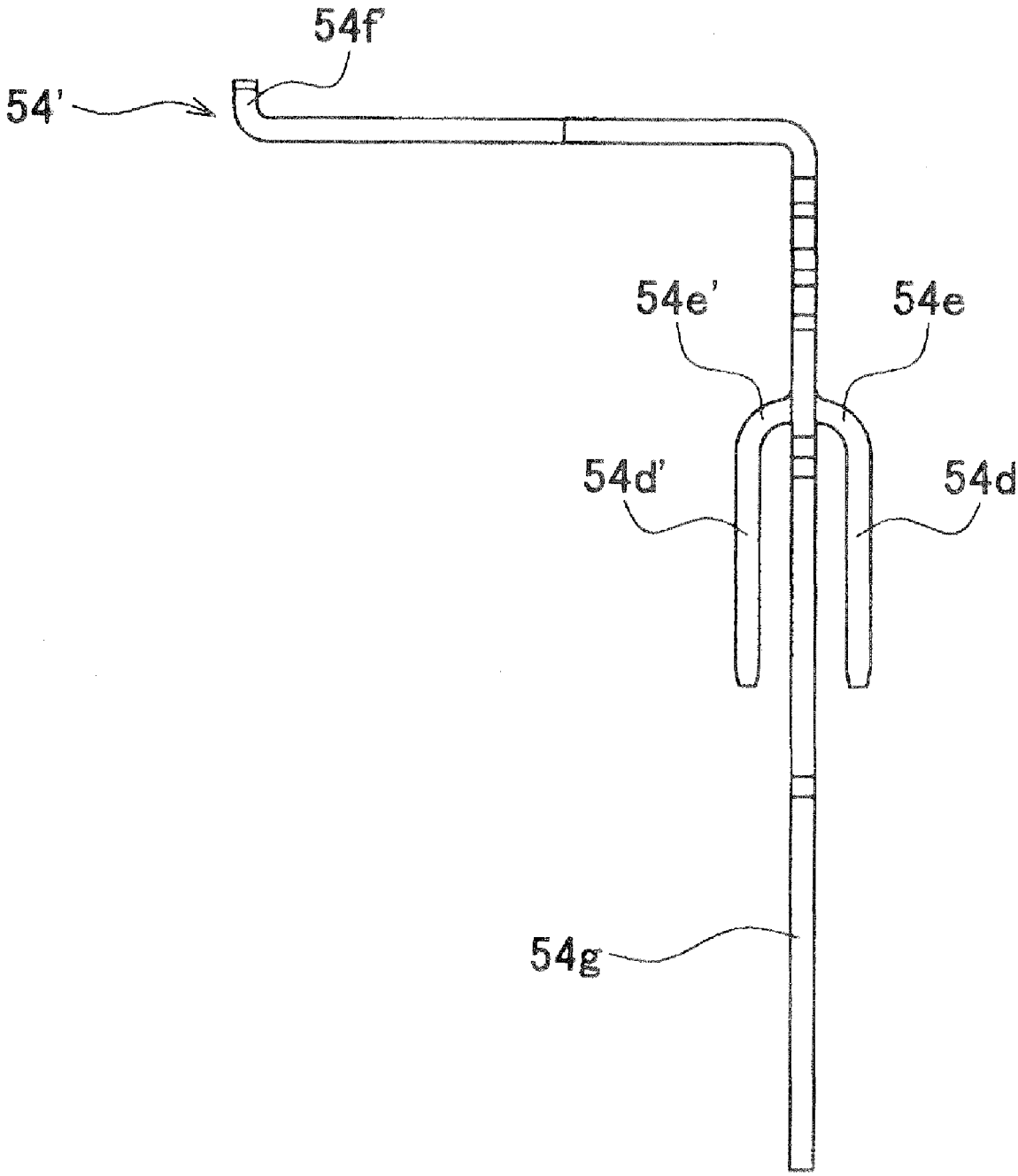
FIG. 5C is a side view of one of the contacts appearing in FIG. 5B.

Similarly, in the contact 54' of the connector 1 according to the present embodiment, the terminal portion 54*d*' is caused to be disposed at the location forward (in the fitting/removing direction A) of the press-fitting portion 54*b*' by the position changing portion 54*e*'. However, insofar as the terminal portions 54*d* of the contacts 54 for non-high-speed transmission and the terminal portions 54*d*' of the contacts 54' for non-high-speed transmission are in a staggered arrangement, the terminal portions 54*d*' may be configured to be disposed at the same locations (in the fitting/removing direction) as the press-fitting portions 54*b*', or at the locations rearward of the same As shown in FIGS. 5A to 5C, the contacts 54 and 54' are formed by blanking and bending a metal plate having elasticity. The lengths of the contacts 54 and 54' in the straight state are equal to each other, which makes it easy to perform bending after blanking. The blanked contacts 54 and 54' are still continuous with a carrier 54*g*.

When performing bending, the position changing portion 54*e* of the contact 54 is bent in a predetermined direction, and the position changing portion 54*e*' of the contact 54' is bent in an opposite direction to the predetermined direction (see FIG. 5C) Even after bending, the contacts 54 and the contacts 54' are continuous with the carrier 54*g*. This makes it possible to press-fit the contacts 54 and the contacts 54' in the associated press-fitting grooves 32*a* along the direction of the height H of the housing 3 at a time. After press-fitting the press-fitting portions 54*b*, 54*b*' of the contacts 54, 54' in the press-fitting grooves 32*a*, the carrier 54*g* is cut off from the contacts 54, 54'.

The shell 7 is made of a metal and has electrical conductivity. As shown in FIGS. 1A to 1C, the shell 7 has leg parts 7*a*, contact parts 7*b*, and locking pieces 7*c*. The leg parts 7*a* are soldered to through respective associated holes 21*c* of the printed board 21 (see FIG. 6), and are connected to ground. The contact parts 7*b* are brought into contact with a mating shell 207 of the mating connector 201 via window holes 7*d* formed in side walls of the shell 7 (see FIGS. 7A and 7B). The locking pieces 7*c* are disposed within holes, not shown, formed in the bottom of the shell 7. The locking pieces 7*c* are engaged with the mating shell 207 (see FIG. 7A) of the mating connector 201, to thereby lock the mating shell 207 to the shell 7.

As shown in FIG. 3, the contact portions 51*a* and 52*a* of the first and second signal contacts 51 and 52, and the contact portions 53*a* of the ground contacts 53 are arranged in a row in the contact arranging direction C which is orthogonal to the fitting/removing direction A.

The row formed by the contact portions 51*a* and 52*a* of the first and second signal contacts 51 and 52 and the contact portions 53*a* of the ground contacts 53, and the row formed by only the contact portions 54*a* and 54*a*' of the contacts 54 and 54' are parallel to each other.

The contact portions 51*a* and 52*a* of each pair of first and second signal contacts 51 and 52 are disposed between the contact portions 53*a* of adjacent ones of the ground contacts 53 in the contact arranging direction C. That is, a certain group of contact portions 51*a* and 52*a* of respective first and second signal contacts 51 and 52 are disposed between a contact portion 53*a* of a ground contact 53 belonging to the group and a contact portion 53*a* of a ground contact 53 belonging to another group.

The contact portions 54*a* and 54*a*' of the contacts 54 and 54' are arranged in a row in the contact arranging direction C. A pitch of the first and second signal contacts 51 and 52 and the ground contacts 53 in the contact arranging direction C in their row and a pitch of the contacts 54 and 54' in the contact arranging direction C in their row are different from each other.

As shown in FIG. 4, the terminal portions 51*d* and 52*d* of the first and second signal contacts 51 and 52, and the terminal portions 53*d* of the ground contacts 53 are arranged in a row in the contact arranging direction C.

The terminal portions 51*d* and 52*d* of each pair of first and second signal contacts 51 and 52 are disposed between adjacent ones of the terminal portions 53*d* of the ground contacts 53 in the contact arranging direction C.

The terminal portions 54*d* and 54*d*' of the contacts 54 and 54' are arranged in respective two rows in the contact arranging direction C. The row formed by the terminal portions 51*d* and 52*d* of the first and second signal contacts 51 and 52 and the terminal portions 53*d* of the ground contacts 53, and the two rows formed by the terminal portions 54*d* and 54*d*' of the contacts 54 and 54' are parallel to each other. Further, the terminal portions 54*d* of the contacts 54 and the terminal portions 54*d*' of the contacts 54' are arranged in a staggered arrangement. Therefore, if the terminal portions 54*d* and 54*d*' are connected by imaginary straight lines, one zigzag line is formed in which mountain-like shapes each in bilateral symmetry are connected in the contact arranging direction C.

According to this embodiment, the terminal portions 54*d*, 54*d*' of the contacts 54, 54' for non-high-speed transmission are each configured to have a through hole insertion-type pin shape. Therefore, after mounting the connector 1 on the printed board 21, it can be checked by the eye from the reverse side of the printed board 21 whether the terminal portions 54*d*, 54*d*' are positively soldered to the through holes 21*b* of the printed board 21.

Further, when it become necessary to repair the connector 1 mounted on the printed board 21, it is possible, for example, to directly apply a soldering iron (not shown) to the terminal portions 54*d*, 54*d*' protruding from the through holes 21*b*. The terminal portions 51*d* and 52*d* of the first signal contacts 51 and the second signal contacts 52 protrude from the rear wall 32 of the housing 3, which makes it possible to directly apply the soldering iron to them. As a result, the connector 1 can be removed from the printed board 2, and the repair or replacement of the connector 1 can be easily carried out.

Further, the contact portions 51*a* and 52*a* of the first and second signal contacts 51 and 52 for high-speed transmission and the contact portions 53*a* of the ground contacts 53 for high-speed transmission are arranged in a row in the contact arranging direction C, and the contact portions 51*a* and 52*a* of each pair of first and second signal contacts 51 and 52 are disposed between the contact portions 53*a* of the adjacent ground contacts 53 in the contact arranging direction C. This suppresses variation in transmission characteristics or crosstalk between each pair of first and second signal contacts and other pairs of first and second signal contacts, whereby it is possible to prevent degradation in transmission.

Furthermore, the terminal portions 51*d* and 52*d* of each pair of first and second signal contacts 51 and 52 are disposed between the terminal portions 53*d* of adjacent ones of the ground contacts 53 in the contact arranging direction C. This suppresses crosstalk between the terminal portions 51*d* and 52*d* of each pair of first and second signal contacts 51 and 52 and the terminal portions 51*d* and 52*d* of other pairs of first and second signal contacts 51 and 52 which are adjacent thereto, thereby preventing degradation in transmission.

Further, the row formed by the terminal portions 51*d* and 52*d* of the first and second signal contacts 51 and 52 and the terminal portions 53*d* of the ground contacts 53, and the two rows formed by the terminal portions 54*d* and 54*d*' of the contacts 54 and 54' are parallel to each other. This makes it possible to reduce the length of the housing 3 in the contact arranging direction C, and downsize the connector 1. Further, the terminal portions 54*d* of the contacts 54 and the terminal portions 54' of the contacts 54' are disposed in a staggered arrangement. This makes it possible to increase the distance between adjacent ones of the through holes 21*b* in the printed circuit board 21, whereby it is possible to use the contacts 54, 54' as those for power supply which are required to be disposed with significant distances therebetween.

Figure 7A:
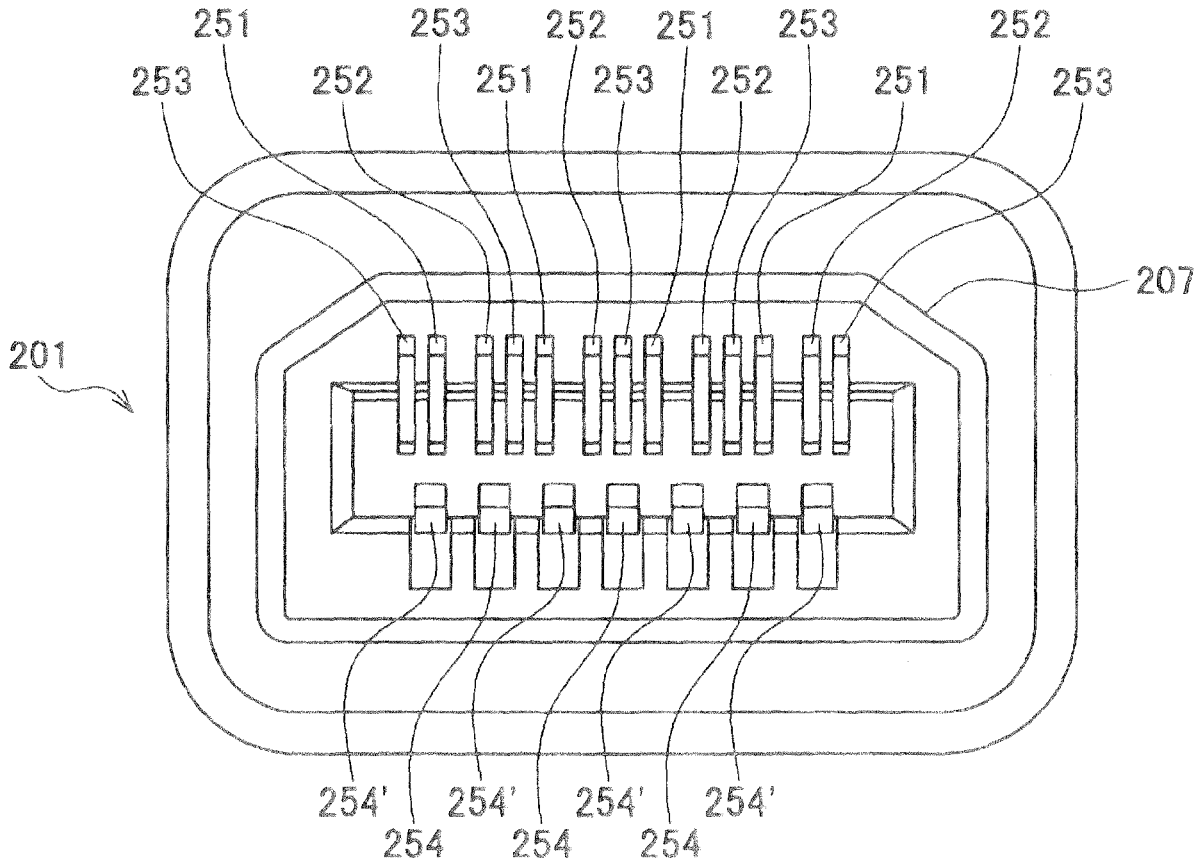
FIG. 7A is a front view of a mating connector to be mated with the connector shown in FIG. 1A.
Figure 7B:
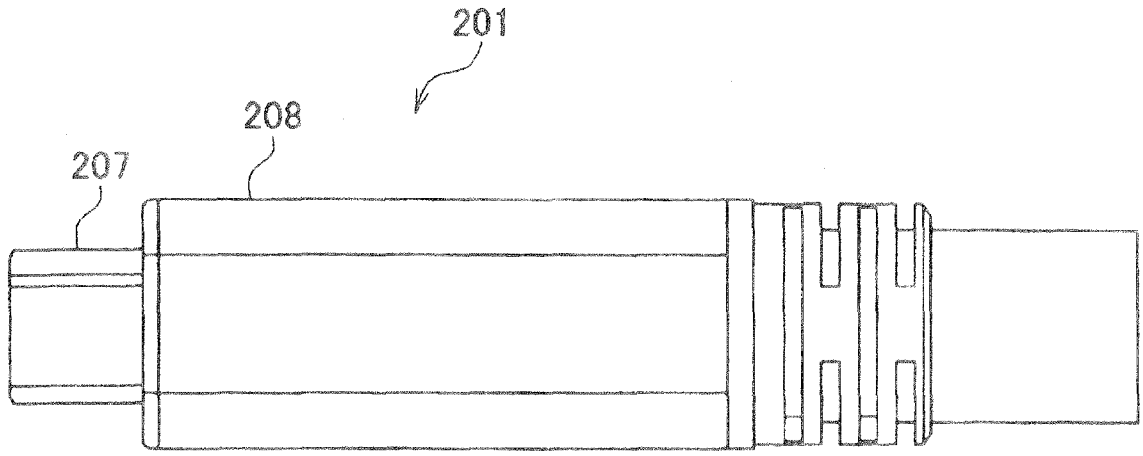
FIG. 7B is a side view of the mating connector.
Figure 8:
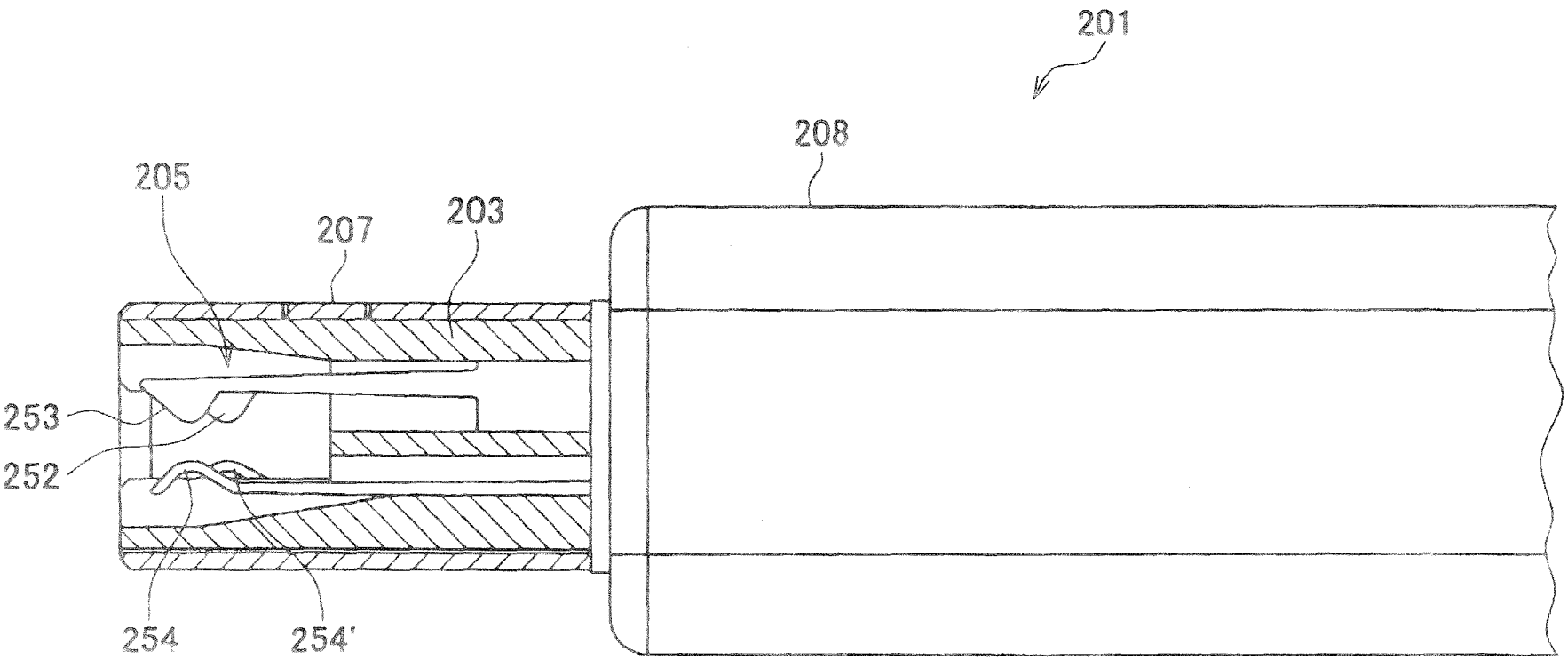
FIG. 8 is a view, partly in cross-section, of the mating connector shown in FIG. 7A.

FIG. 7A is a front view of the mating connector 201 to be mated with the connector shown in FIG. 1A, and FIG. 7B is a side view of the mating connector. FIG. 8 is a view, partly in cross-section, of the FIG. 7A mating connector.

The mating connector 201 corresponds to the mating connector to which the connector 1 shown in FIG. 1A is to be connected.

As distinct from the connector 1 in which the first and second signal contacts 51, 52, the ground contacts 53, and the contacts 54, 54' for non-high-speed transmission are bent into respective L shapes, in the mating connector 201, first and second signal contacts 251, 252, ground contacts 253, and contacts 254, 254' for non-high-speed transmission have respective linear shapes.

In the connector 1, the respective terminal portions (connection portions) 51*d*, 52*d*, 53*d*, 54*d*, and 54*d*' of the contacts 51, 52, 53, 54, and 54' have respective shapes 54 for being mounted on the printed ports, but in the connector 201, connection portions, not shown, of the contacts 251, 252, 253, 254, and 254' have respective shape connectable to cables.

Although in the connector 1, the terminal portions 54*d*, 54*d*' of the contacts 54, 54' for non-high-speed transmission are in a staggered arrangement, and are in respective two parallel rows, in the connector 201, the connection portions of the contacts 254, 254' are in one row in the connector arranging direction. The connector 201 is not different from the connector 1 shown in FIG. 1A in that the row of the connection portions of the contacts 254 and 254' are in parallel with the row of the contacts 251, 252, and 253.

As shown in FIG. 7A, the arrangement of the contact portions of the contacts 251, 252, 253, 254, and 254' is the same as that of the contact portions 51*a*, 52*a*, 53*a*, 54*a*, and 54*a*' of the contacts 51, 52, 53, 54, and 54' shown in FIG. 3.

A mating shell 207 is covered with a hood 208 except the front end thereof.

It should be noted that although in the connector 1 and the mating connector 201, the distance in the contact arranging direction C between each pair of signal contacts 51 and 52 and each pair of signal contacts 251 and 252 are wider than the distances between each pair of signal contacts 51 and 52 and a ground contact 53 adjacent thereto and those between each pair of signal contacts 251 and 252 and a ground contact 253 adjacent thereto, as shown in FIGS. 3, 4, and 7A, these distances may be configured to be equal to each other.

It is further understood by those skilled in the art that the foregoing are the preferred embodiments of the present invention, and that various changes and modification may be made thereto without departing from the spirit and scope thereof.

What is claimed is:

1. A connector comprising:

a housing that is capable of being fitted to a mating housing of a mating connector; and a plurality of contacts that are held by said housing, said plurality of contacts including pairs of signal contacts for high-speed transmission, ground contacts for high-speed transmission, and contacts for non-high-speed transmission, wherein each of said signal contacts for high-speed transmission, said ground contacts for high-speed transmission, and said contacts for non-high-speed transmission has a contact portion which is capable of being brought into contact with a contact portion of a mating contact of the mating connector, and a connection portion which is connected to an object to be connected, wherein said contact portions of said signal contacts for high-speed transmission and said contact portions of said ground contacts for high-speed transmission are arranged in a row in a contact arranging direction which is orthogonal to a connector fitting direction, wherein said contact portions of each pair of said signal contacts for high-speed transmission are disposed between said contact portions of adjacent ones of said ground contacts for high-speed transmission adjacent in the contact arranging direction, wherein said contact portions of said contacts for non-high-speed transmission are arranged in a row in the contact arranging direction, wherein the row formed by said contact portions of said signal contacts for high-speed transmission and said contact portions of said ground contacts for high-speed transmission, and the row formed by said contact portions of said contacts for non-high-speed transmission are parallel to each other, wherein said connection portions of said signal contacts for high-speed transmission and said connection portions of said ground contacts for high-speed transmission are arranged in a row in the contact arranging direction, wherein said connection portions of each pair of said signal contacts for high-speed transmission are disposed between said connection portions of adjacent ones of said ground contacts for high-speed transmission adjacent in the contact arranging direction, wherein said connection portions of said contacts for non-high-speed transmission are arranged in two rows in the contact arranging direction, wherein the row formed by said connection portions of said signal contacts for high-speed transmission and said connection portions of said ground contacts for high-speed transmission, and the rows formed by said connection portions of said contacts for non-high-speed transmission are parallel to each other, wherein the row formed by said connection portions of said signal contacts for high-speed transmission and said connection portions of said ground contacts for high-speed transmission is disposed rearward in the connector fitting direction with respect to the rows formed by said connection portions of said contacts for non-high-speed transmission, wherein said connection portions of said contacts for non-high-speed transmission are between said contact portions and said connection portions of said signal contacts for high-speed transmission and said ground contacts for high-speed transmission in the connector fitting direction, wherein said connection portions of said contacts for non-high-speed transmission are in a staggered arrangement, wherein each of said connection portions of said contacts for high-speed transmission and said connection portions of said ground contacts for high-speed transmission has a surface-mount type planar shape, wherein each of said connection portions of said contacts for non-high-speed transmission has a through hole insertion-type pin shape, and wherein said connection portions of said signal contacts for high-speed transmission and said connection portions of said ground contacts for high-speed transmission protrude out of said housing.

2. A connector as claimed in claim 1, wherein each of said plurality of contacts has a substantially L-shape.

3. A connector as claimed in claim 1, wherein each of said plurality of contacts is formed by blanking and bending a metal plate having elasticity.

4. A connector as claimed in claim 2, wherein each of said plurality of contacts is formed by blanking and bending a metal plate having elasticity.

* * * * *